US009986769B1

(12) United States Patent
Liu et al.

(10) Patent No.: US 9,986,769 B1
(45) Date of Patent: Jun. 5, 2018

(54) ATOMIZER FOR AN ELECTRONIC CIGARETTE

(71) Applicants: Lily Liu, Hicksville, NY (US); Fu Yuan Cai, Wenzhou (CN); Benjamin Hickman, Kirksville, MO (US)

(72) Inventors: Lily Liu, Hicksville, NY (US); Fu Yuan Cai, Wenzhou (CN); Benjamin Hickman, Kirksville, MO (US)

( * ) Notice: Subject to any disclaimer, the term of this patent is extended or adjusted under 35 U.S.C. 154(b) by 0 days. days.

(21) Appl. No.: 15/442,188

(22) Filed: Feb. 24, 2017

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 9,155,336 B2 * 10/2015 Liu ..... A24F 47/002
2013/0037041 A1 * 2/2013 Worm ..... A24F 47/008
131/329
2013/0192615 A1 * 8/2013 Tucker ..... H01C 17/00
131/328

* cited by examiner

*Primary Examiner* — Tho D Ta

(57) ABSTRACT

Disclosed is an atomizer that comprises a transparent, elongated e-liquid cartridge enclosed in a transparent, elongated outer cylinder that creates a well-defined smoke-flowing interlayer or pathway that leads from an atomization tube mounted on the distal end of the outer cylinder to a cigarette holder disposed at its proximal end. The atomization tube contains a heating coil in a porcelain cup in contact with an e-liquid rope or wick extruding from an e-liquid guiding head that seals the e-liquid cartridge at its distal end. Mounted on the atomization tube are two conductive members that connect with the heating coil and with an appropriate battery assembly containing an air-flow sensor that provides an electric charge when a smoker inhales. A smoker's inhalation also creates negative pressure within the interlayer pathway and the cartridge causing e-liquid to permeate the wick for vaporization. The resulting vapor or smoke travels to the cigarette holder and smoker via the interlayer. The cartridge is sealed at its proximal end by a sealing plug which is reinforced by a cap on the outer cylinder. The cap has smoke vents which communicate with the smoke-flowing interlayer. The separate smoke-flowing interlayer preserves the purity of the vapor, eliminates leaking, and allows the smoker better control of consumption through its transparency.

6 Claims, 4 Drawing Sheets

ATOMIZER FOR AN ELECTRONIC CIGARETTE

BACKGROUND OF THE INVENTION

1. Field of the Invention

The present utility model relates to an electronic cigarette, more particularly to an electronic cigarette atomizer that is adapted to prevent leakage and waste of the electronic liquid product and to maximize the experience of smoking.

2. Background Art

In the American culture smoking processed tobacco is no longer a socially acceptable activity as anti-smoking legislation throughout the nation has practically driven cigarette smokers to the shadows in public and in private. Similarly, anti-smoking media campaigns highlighting the health risks smoking tobacco entails have made smoking cigarettes taboo, culturally speaking, in almost every family. But a significant portion of the public still desires the smoking experience and, as a consequence, electronic cigarettes have become preferable substitutes because they eliminate unhealthy tar, offensive odor, filthy ash, and other pollution from the environment. Additionally, electronic cigarettes not only eliminate many of the more objectionable and unhealthy aspects of smoking tobacco, their use have also been promoted as a means to free oneself from an unhealthy dependence on smoking cigarettes, pipes, cigars and tobacco in any form. A social by-product of this cultural change is the elimination of the risk of accidental fires associated with burning such tobacco implements. Finally, and most important, electronic smoking devices can also expand the range of the smoking experience because they typically utilize an atomizer to vaporize a liquid to produce a vapor that is inhaled by a user. Thus, not only is nicotine vaporized but a variety of liquids can be "smoked", including liquids for medical treatment and for nutrients.

During the last decade electronic cigarettes became commercially viable devices for smoking nicotine as a substitute for smoking tobacco, and a practical means of smoking other liquid products. The most common electronic cigarettes on the market are elongated and spherical in form similar to tobacco cigarettes. A basic component of a typical electronic cigarette device is an electronic power source or a battery assembly consisting of a lithium ion battery, a computer chip and circuit board, and a sensor to trigger an electric charge to an atomizer. The battery assembly may be rechargeable or not. Other basic components are an e-liquid storage compartment and an atomizer to convert the liquid to a vapor to be inhaled through a mouthpiece. The atomizer contains a heating element powered by the battery assembly. The e-liquid is usually stored in a separate compartment but in direct communication with the atomizer by some means. The mouthpiece is usually at the end opposite to the battery assembly. The user of the electronic cigarette inhales through the mouthpiece creating an airflow or other pressure that signals a sensor to activate the atomizing process—the vaporization of the liquid by the heating elements.

The arrangement of the basic internal components of an electronic cigarette are varied, although their outer form is usually akin to the elongated spherical form of a tobacco cigarette, The battery assembly, atomizer, e-liquid container, and mouthpiece are found in various juxtapositions to one another and in various complexities. Some examples are found in U.S. Pat. Nos. 9,497,999; 9,439,455; 9,364,027; 8,899,240. One of the enduring problems that the various arrangements have to deal with is that of leakage of the e-liquid that occurs during its delivery to the heating elements for atomization. Leaking also happens when there is inadequate atomization which causes a buildup of liquid outside the e-liquid compartment. Not only does the leaking diminish the amount of e-liquid that can be vaporized but, due to the leakage, the e-liquid is insufficient for atomization resulting in dry burning and/or an accumulation of an aerosol mass which can shorten the life span of the atomizer. And where there is no consistent "burn" by the heating elements because of the buildup of liquid in the atomization compartment the liquid can seep into the mouthpiece. This is especially so where the mouthpiece is in close proximity to the heating elements as in U.S. Pat. No. 9,439,455 which dispenses the e-liquid though a porous, screened aperture or mesh dividing a liquid compartment and a heating element. A more complicated arrangement with the same result is found in U.S. Pat. No. 9,364,027 which uses valves and pumps to deliver the liquid to a heating element which is adjacent to the mouthpiece. Similarly, in U.S. Pat. No. 8,899,240 where the mouthpiece consists of an integrated liquid storage chamber and atomizer, atomization requires leakage of liquid from the storage chamber to a filter to a sponge that is in contact with the heating element. These types of arrangements almost guarantee seepage of e-liquid to internal spaces of the device and to the mouth of the user, along with the vapor. Finally, in almost every one of the various arrangements and operations of the basic components found in the prior art, the flow-path of the smoke or vapor to the user's mouth is through the e-liquid, as it is inhaled by the user. This necessarily effects the taste and quality of the vapor that is consumed as condensation of the vapor occurs.

SUMMARY OF THE DISCLOSURE

The present utility model of a leak proof, high performance atomizer is made in view of the above state of the art. The objective of the present utility model is to provide an electronic cigarette atomizer with excellent performance on preventing leaking, insuring efficient vaporization, and delivering a quality taste while also providing the user with a real-time gauge of the amount of e-liquid remaining to be smoked.

The present utility model discloses an atomizer for an electronic cigarette that provides a simple but elegant solution to the problem of leaking e-liquid and obtaining a consistent vaporization and a quality taste. The placement of an e-liquid cartridge inside an outer cylinder creates a smoke-flowing interlayer from an atomization tube at the distal end to the cigarette holder and cap at the proximal end of the outer cylinder. The e-liquid cartridge is sealed firmly at both ends and vaporization takes place outside in the atomization tube, which opens onto the smoke-flowing interlayer. The smoke or vapor travels to the user's mouth through the isolated interlayer as the user inhales. This arrangement eliminates any opportunity for the e-liquid to escape the e-liquid cartridge. Moreover, the smoke-flowing pathway to the user's mouth always separates the vapor from the e-liquid, eliminating loss of vapor and taint of taste because of condensation.

This means of atomization avoids dry burning and a build-up of liquid or aerosol mass as the e-liquid is bumped back to the cartridge after inhalation and smoking ceases. Another advantage of this utility model is that the outer cylinder and the cartridge are made of high transparent quartz, plastic, glass or other transparent materials. Because the outflow of the e-liquid can be adjusted by the user's inhalation, the ability to view the amount of e-liquid in the cartridge and thereby control the rate of consumption is an attractive feature. Finally, the present disclosure enables one to create an electronic cigarette by simply attaching a standard, rechargeable battery assembly containing an air flow sensor to activate the atomizer's vaporization process.

STRUCTURE OF THE ATOMIZER

The atomizer comprises an elongated outer cylinder and an elongated cartridge for storage of an e-liquid disposed inside the outer cylinder whereby an interlayer or smoke-flowing pathway is formed between the outer cylinder and cartridge. Fitted atop the distal end of the outer cylinder is an atomization tube that has mounted thereon a first conductive member, with a second conductive member disposed therein but insulated from the first conductive member. The second conductive member has an air vent in its center. The first conductive member can be configured to be releasably connected to a battery assembly as a power source by a threaded connection, snap-fit or other means. A porcelain cup is disposed inside the atomization tube below the first and second conductive members. The porcelain cup contains a heating coil with wires leading from the two ends of the heating coil connecting with the first and second conductive members respectively, creating an electrical circuit. An e-liquid guiding head, sized to fit within and seal the distal end of the e-liquid cartridge, contains an e-liquid guiding rope or wick in a through hole. One end of the e-liquid guiding rope is located in the cartridge and the other end protrudes into the atomizer's porcelain cup making contact with the heating coil. When a user inhales negative pressure is created in the interlayer and cartridge impelling the e-liquid into contact with the heating coil by means of the wick. Simultaneously, the battery assembly, responding to the motion sensor, activates the heating process in response to a user's inhalation and the e-liquid is vaporized in the atomization tube. The vapor is drawn into the interlayer or pathway towards the cigarette holder. When the user ceases to inhale, the heating process diminishes and the e-liquid recedes.

The vapor flows via the interlayer to a cigarette holder disposed at the proximal end of the outer cylinder. The cigarette holder contains a cap with smoke vents opening onto the interlayer, thereby serving as a mouthpiece while also capping the interlayer pathway. A sealing plug seals the e-liquid cartridge at the cigarette holder's end. The sealing plug abuts the cap of the cigarette holder, thereby reinforcing the sealing of the cartridge at the proximal end.

DRAWINGS—REFERENCE NUMERALS

Figure 1:
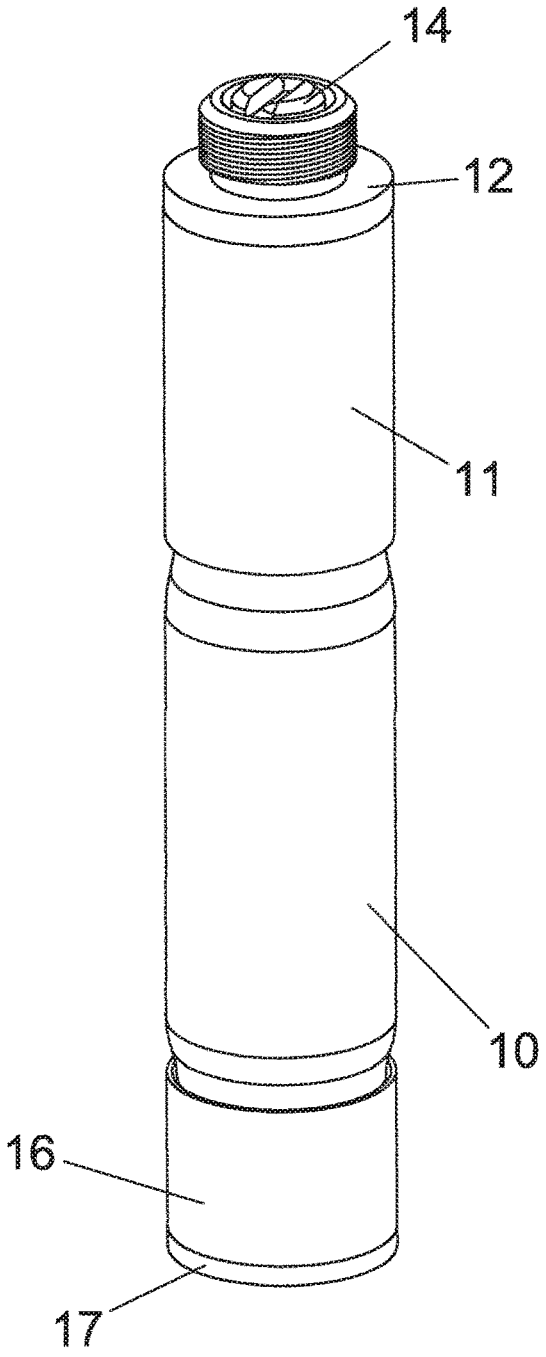
FIG. 1 is an overall structural view of the electronic cigarette atomizer fully assembled without a battery assembly attached in accordance with the present invention.

10 outer cylinder
11 atomization tube
12 first conductive member
13 insulation set
14 second conductive member
15 porcelain cup
16 cigarette holder
17 cap
18 retaining rings
20 cartridge
21 e-liquid guiding head
22 sealing plug
30 smoke flowing interlayer
141 air vent
151 heating coil
152 heating wires
171 smoke vent
172 expansion head
181 positioning protrusions
211 through hole
212 e-liquid guiding rope
221 expansion hole

DETAILED DESCRIPTION OF THE PREFERRED EMBODIMENT

Although a specific embodiment of the present disclosure will now be described with reference to the drawings, the following description is only one example of a variety of specific embodiments representative of the principles of the invention. Various changes and modifications obvious to one skilled in the art pertaining to the present disclosure are deemed to be within the spirit, scope and contemplation of the present disclosure as further defined in the appended claims.

FIG. 1 depicts an embodiment of an atomizer for an electric cigarette without a battery assembly connected. It shows an attractive exterior consisting of three distinct parts—an atomization tube 11, an outer cylinder 10, and a cigarette holder 16 fitted with a cap 17 at the bottom. The atomization tube 11 and the cigarette holder 16 are made of metal, while the outer cylinder 10 is made of transparent quartz. Atop the atomization tube 11 is a first conductive member 12 with a second conductive member 14 set therein. The first conductive member 12 can be releasably connected to the atomization tube 11 by screw threads on its lower half and can contain screw threads on its upper half to releasably connect with an appropriate battery assembly configured to so connect. See FIG. 4.

Figure 2:
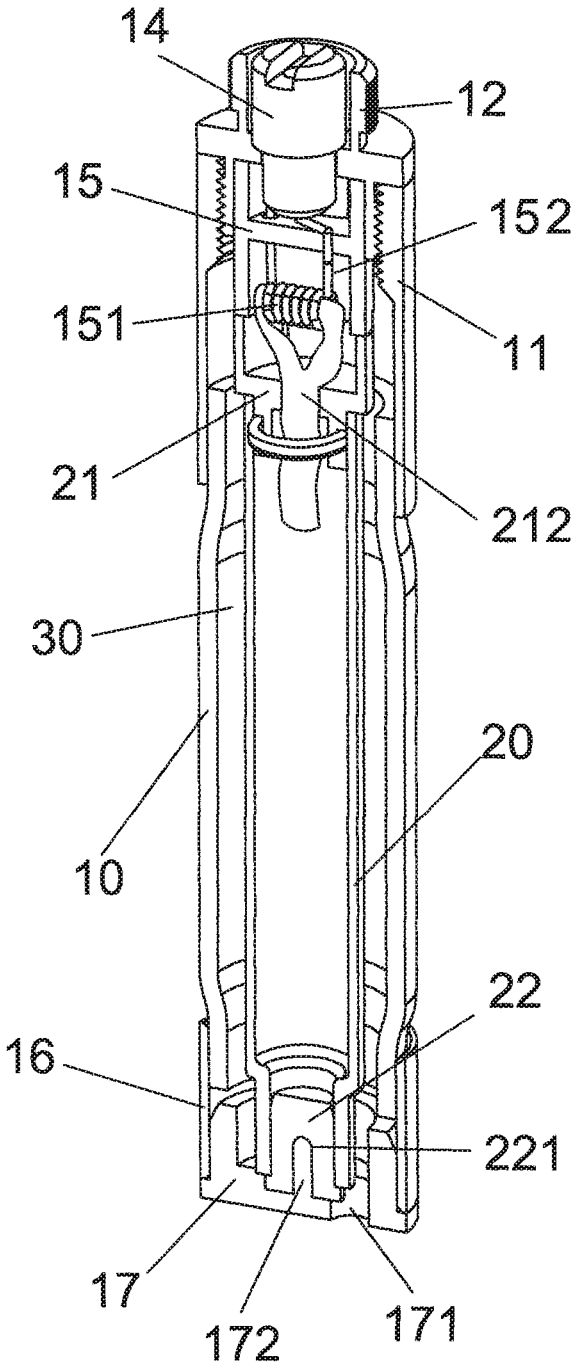
FIG. 2 is an enlarged cross section, longitudinal view of the electronic cigarette atomizer fully assembled without a battery assembly attached.
Figure 3:
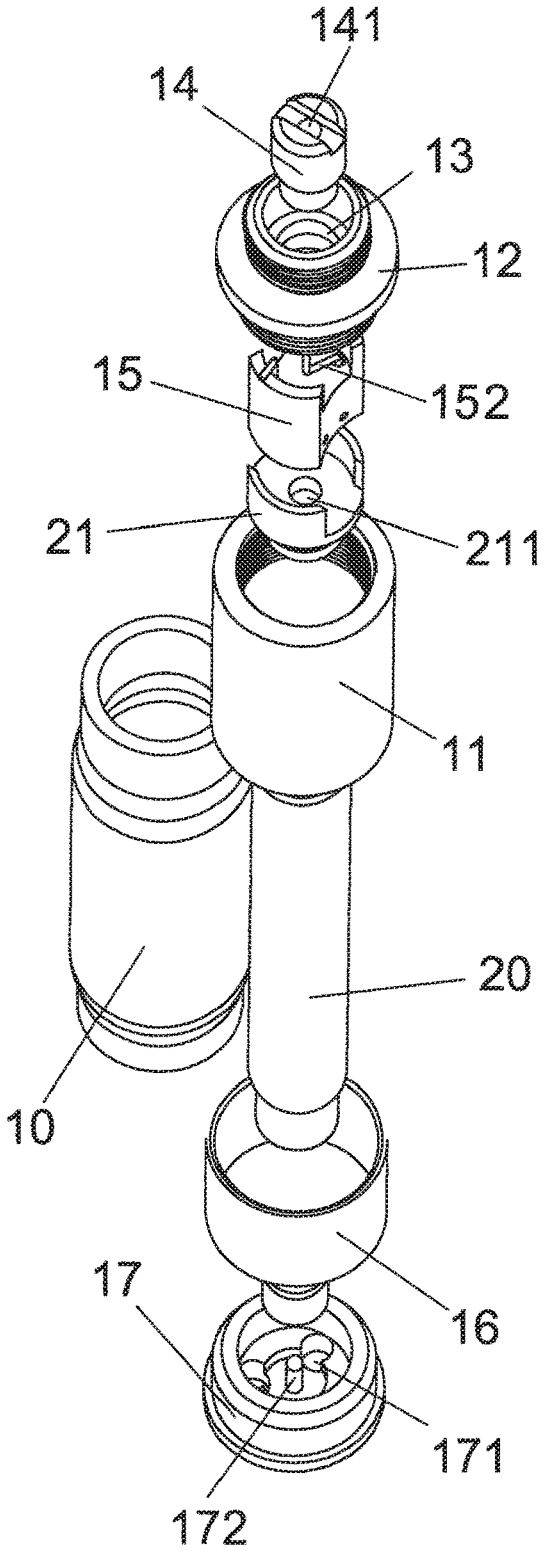
FIG. 3 is a first, partially exploded view of the electronic cigarette atomizer without a battery assembly attached.
Figure 4:
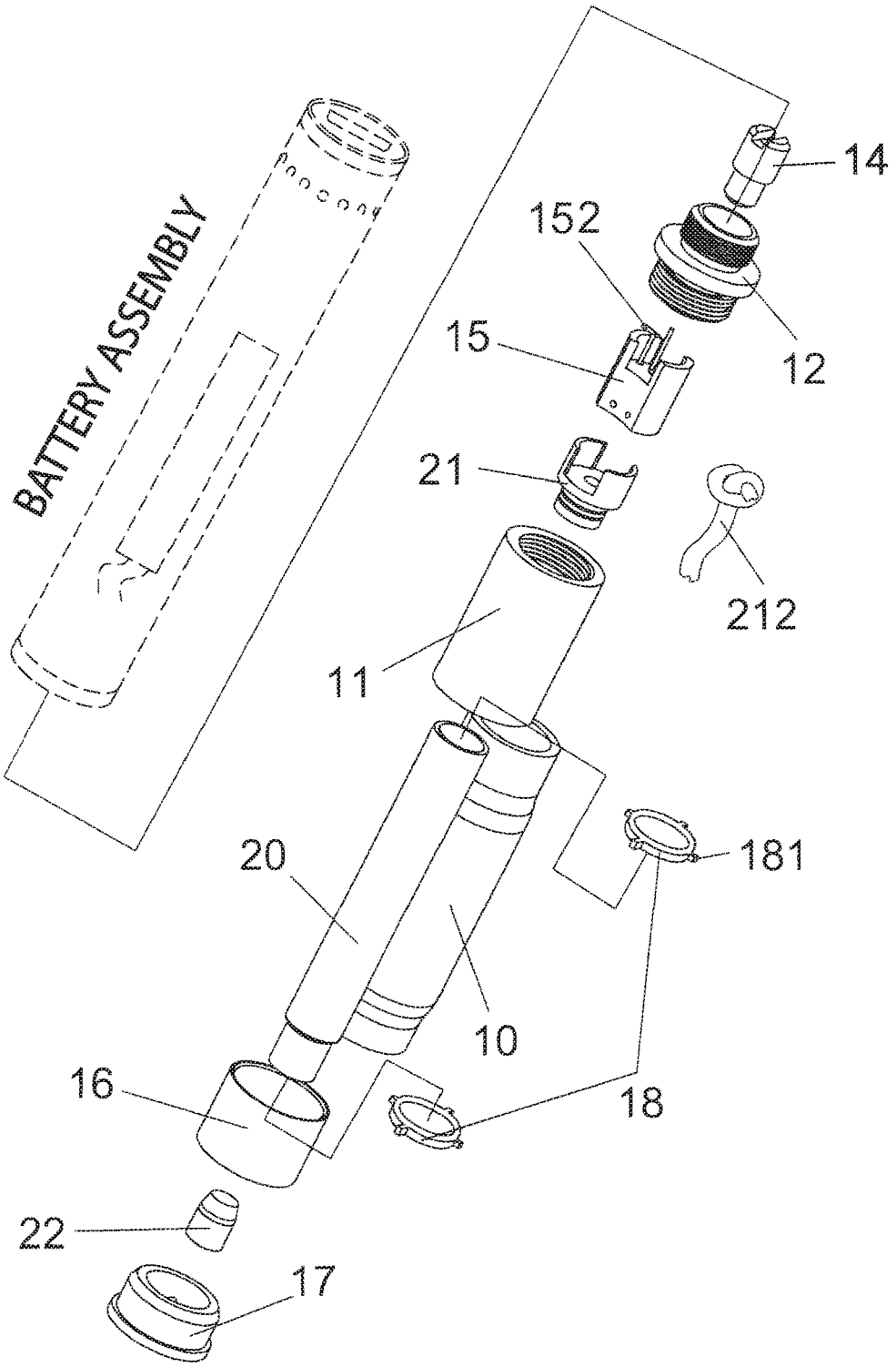
FIG. 4 is a fully exploded view of the components of the electronic cigarette atomizer showing the position of a standard battery assembly when connected.

FIG. 2 illustrates by means of a longitudinal cross-section view the construction and orientation of the e-liquid storage cartridge 20 disposed inside the outer cylinder 10 thereby forming a smoke-flowing interlayer 30 or pathway from the atomization tube 11 to the cigarette holder 16. Both the outer cylinder 10 and the inner cartridge 20 are made of high transparent quartz, plastic, glass or other transparent material that enables a user to determine the volume of e-liquid contained in the cartridge 20. FIG. 2 and the exploded views of FIG. 3-4 depict a porcelain cup 15 disposed inside the atomization tube 11 with a heating coil 151 disposed inside the porcelain cup 15. Two heating wires 152 from the respective ends of the heating coil 151 extend to and connect with the first and second conductive members 12 and 14 respectively, forming an electrical circuit when a battery assembly is connected. The first and second conductive members 12 and 14 are insulated from one another by an insulation set 13. The second conductive member 14 has an air vent 141 in the center thereof. At its distal end, beneath the heating coil 151, the cartridge 20 is configured to receive an e-liquid guiding head 21 sized to fit snugly within the cartridge 20 and to effect a seal of the cartridge 20 at that end. The guiding head 21 is configured with a through hole 211 in the center through which passes an e-liquid guiding rope 212 or wick, which should be a non-flammable, absorbent material. One end of the guiding rope 212 extends into the e-liquid cartridge 20 and the other end is in contact with the heating coil 151 in the porcelain cup 15 to effect delivery of e-liquid to the heating coil 151.

In this embodiment, the outer walls of the two ends of the cartridge 20 are sleeved with retaining rings 18 configured with a plurality of positioning protrusions 181 uniformly arranged on the outer cylindrical surface of the retaining rings 18 in radial symmetry. The positioning protrusions 181 are in contact with the inner wall of the outer cylinder 10 for coaxial positioning and stability of the cartridge 20 within the outer cylinder 10.

When the heating coil 151 in contact with the e-liquid guiding rope 212 is activated by an electric charge, the resulting vapor enters the pathway of the smoke-flowing interlayer 30 in response to the negative pressure generated by the user's inhalation and flows towards a cigarette holder 16 configured to enclose the outer cylinder 10 and cartridge 20 at the end opposite to the atomization tube 11. At the latter end the e-liquid cartridge 20 is sealed by a sealing plug 22 and the cigarette holder 16 is configured to fit over the outer cylinder 10. A cap 17 having smoke vents 171 is disposed at the end of the cigarette holder 16. The sealing plug 22 and the cap 17 abut against one another so as to reinforce the sealing of the cartridge 20. The sealing plug 22 contains an expansion hole 221 sized to receive an expansion head 172 contained in the middle of the cap 17 which, when inserted, further reinforces the sealing of the cartridge 20 at that end. In this embodiment, three smoke vents 171 are annularly and uniformly arranged on the cap 17. The smoke vents 171 communicate with the smoke flowing interlayer 30, thereby serving as a mouthpiece for the user to activate the atomization process by inhalation.

In this embodiment, an air passage is created from the air vent 141 of the second conductive member 14 through the atomization tube 11 and the smoke-flowing interlayer 30 to the smoke vents 171. The sum of the cross-sectional areas of the smoke vents 171 is larger than that of the air vent 141. Therefore when a user inhales the air inflow rate of the air vent 141 is less than the air outflow rate of the smoke vents 171 resulting in the formation of negative pressure in the interlayer 30 and in the e-liquid cartridge 20 as well. The result of the negative pressure is that the e-liquid in the cartridge 20 is impelled to permeate more quickly the e-liquid guiding rope 212 leading to the heating coil 151 in the porcelain cup 15. The result is a good, consistent atomization as long as the user inhales. Once the smoker stops inhaling and the negative pressure ceases in the cartridge 20, the excess e-liquid quickly returns back to the cartridge 20 under normal atmospheric pressure, thereby avoiding any waste of e-liquid by leakage, build-up, or seepage into the interlayer 30. Also the smoke-flowing interlayer 30 segregated from the cartridge 20 avoids the effects of condensation of the vapor that occur when the vapor has to pass through a compartment containing the e-liquid.

The foregoing detailed description is only a preferred embodiment and various modifications and variations may be made to the embodiment by anyone of ordinary skill in the art without departing from the spirit and scope of the disclosure.

What is claimed is:

1. An atomizer for an electronic cigarette, comprising:

an elongated outer cylinder with an elongated e-liquid cartridge disposed inside said outer cylinder in such a manner that a smoke-flowing interlayer is formed between said outer cylinder and said e-liquid cartridge, extending from an atomization tube disposed at one end of said outer cylinder to a cigarette holder disposed at the opposite end of said outer cylinder;

a first conductive member disposed at the other end of said atomization tube, whereby said first conductive member can be releasably connected to a battery assembly with a motion flow sensor as a power source;

a second conductive member disposed in the middle of said first conductive member and insulated therefrom by an insulation set;

said second conductive member containing an air vent;

a porcelain cup disposed inside said atomization tube;

a heating coil disposed inside said porcelain cup with heating wires connecting with said first and second conductive members respectively;

an e-liquid guiding head disposed at the end of said e-liquid cartridge beneath said porcelain cup, wherein a through hole is provided with an e-liquid guiding rope or wick disposed therein, whereby one end of said e-liquid guiding rope is located in said e-liquid cartridge and the other end is contiguous to said heating coil in said porcelain cup;

a cap with smoke vents communicating with said smoke-flowing interlayer disposed at the end of said cigarette holder so as to allow air to flow from said smoke vents to said air vent in said second conductive member;

a sealing plug disposed at the end of said e-liquid cartridge opposite to said e-liquid guiding head abuts against said cap so as to realize the sealing of said cartridge;

whereby said atomizer for an electronic cigarette is constructed and arranged such that atomization of an e-liquid occurs in response to a user's inhalation in a controllable and efficient manner and without leakage or waste from a sealed e-liquid cartridge enclosed in an outer cylinder that also provides a smoke-flowing pathway to consumption that preserves the quality and taste of the vaporized e-liquid.

2. The electronic cigarette atomizer of claim 1 wherein said smoke vents are annularly and uniformly arranged on said cap.

3. The electronic cigarette atomizer of claim 1 wherein the sum of the cross-sectional areas of said smoke vents is larger than that of said air vent of said second conductive member.

4. The electronic cigarette atomizer of claim 1 wherein said outer cylinder in part and said e-liquid cartridge are made of high transparent quartz.

5. The electronic cigarette atomizer of claim 1 wherein said sealing plug contains an expansion hole in the center of its surface and said cap contains an expansion head sized to fit within said expansion hole when said cap abuts against said sealing plug so as to reinforce sealing of said cartridge.

6. The electronic cigarette atomizer of claim 1 wherein the outer walls of said e-liquid cartridge are sleeved with retaining rings containing a plurality of positioning protrusions uniformly arranged in a radial direction which are in contact with the inner wall of said outer cylinder for coaxial positioning and stability of said cartridge within said outer cylinder.

* * * * *